US005832551A

United States Patent [19]

Wagner

[11] Patent Number: 5,832,551

[45] Date of Patent: Nov. 10, 1998

[54] METHOD OF MAKING AN INNERSPRING ASSEMBLY OR MATTRESSES, CUSHIONS AND THE LIKE

[75] Inventor: Robert F. Wagner, Medina, Ohio

[73] Assignee: Ohio Mattress Company Licensing and Components Group, Middleburg Heights, Ohio

[21] Appl. No.: 468,840

[22] Filed: Jun. 6, 1995

Related U.S. Application Data

[60] Division of Ser. No. 205,933, Mar. 3, 1994, Pat. No. 5,467,488, which is a continuation-in-part of Ser. No. 84,735, Jun. 29, 1993, abandoned, and a continuation of Ser. No. 833,683, Feb. 11, 1992, Pat. No. 5,239,715.

[51] Int. Cl.[6] ..... A47C 27/00

[52] U.S. Cl. ..... 5/718; 5/717

[58] Field of Search ..... 5/716–721, 739

[56] References Cited

U.S. PATENT DOCUMENTS

| | | |
|---|---|---|
| 1,192,510 | 7/1916 | Fischmann . |
| 1,865,043 | 6/1932 | Pittoni . |
| 2,408,382 | 10/1946 | Dubick . |
| 2,826,769 | 3/1958 | Drews . |
| 2,940,089 | 6/1960 | Koenigsberg . |
| 3,251,078 | 5/1966 | Calla . |
| 3,262,135 | 7/1966 | Fasanella . |
| 3,310,819 | 3/1967 | Morrison . |
| 3,401,411 | 9/1968 | Morrison . |
| 3,517,398 | 6/1970 | Patton . |
| 3,618,146 | 11/1971 | Ferdinand . |
| 3,822,426 | 7/1974 | Mistarz . |
| 3,848,283 | 11/1974 | Ikeda . |
| 4,067,076 | 1/1978 | Krier . |
| 4,677,701 | 7/1987 | Golumbrek . |
| 4,907,309 | 3/1990 | Breckle . |
| 5,048,167 | 9/1991 | Heffley . |
| 5,113,539 | 5/1992 | Strell . |
| 5,133,116 | 7/1992 | Wagner et al. . |
| 5,469,590 | 11/1995 | Simon . |

FOREIGN PATENT DOCUMENTS

| | | |
|---|---|---|
| 2015659 | 10/1970 | Germany . |
| 2912461 | 10/1980 | Germany . |

*Primary Examiner*—Flemming Saether
*Attorney, Agent, or Firm*—Brinks Hofer Gilson & Lione

[57] ABSTRACT

An elongate member of resilient material for use in the innerspring of a mattress, cushion or the like, is inserted between adjacent springs rows with its major cross-sectional axis extending perpendicular to the support surface. The cross-section of the resilient member is such that it increases from a minimum at or near the ends of a major axis to a maximum along a minor axis. The method of making the resilient member further contemplates matching the combination of cross-section and type of resilient material to the spring rate of the springs between which the member extends. When placed as a beam between springs defining the innerspring perimeter and interior springs adjacent thereto, this arrangement results in an assembly with a border of greater firmness, without a significantly harsh transition between compression of the border area and the innerspring interior area.

19 Claims, 3 Drawing Sheets

METHOD OF MAKING AN INNERSPRING ASSEMBLY OR MATTRESSES, CUSHIONS AND THE LIKE

This application is a division of U.S. Ser. No. 08/205,933, filed Mar. 3, 1994, now U.S. Pat. No. 5,467,488, which is a continuation in part of U.S. Ser. No. 08/084,735, filed Jun. 29, 1993 (abandoned), and a continuation of U.S. Ser. No. 07/833,683, filed Feb. 11, 1992, now U.S. Pat. No. 5,239,715.

FIELD OF THE INVENTION

This invention relates to stabilizers and reinforcers for innersprings, such as spring mattresses, cushions and the like, and a method of making innerspring assemblies using the same.

BACKGROUND OF THE INVENTION

Innerspring assemblies for mattresses or cushions are generally composed of a plurality of spring coils arranged side-by-side in parallel rows, with parallel columns also formed orthogonal to the rows. Border wires usually encircle both the upper and lower perimeters of the support surface formed by the innerspring, such as in a mattress, and connect to terminal convolutions of the perimetrical springs by way of small diameter helical springs which wrap around the border wire.

The terminal convolutions of the coil springs are typically formed with an enlarged diameter compared to the spirals or turns, that are axially inward from the coil ends. This allows for interengagement of the spring terminal ends, as along rows and/or columns, and stabilizes the spring under compression. It is a common practice to overlap the terminal convolutions of adjacent spring coils in a row, and then wind even smaller diameter helical spring coils, referred to as cross-helicals, across the rows to encircle the overlapped terminal convolution portions.

With respect to innerspring edges, i.e., the sides of the unit, there are some general considerations of manufacture and comfort that underlie their design. In the normal use of an innerspring, the edges are subjected to greater compression forces than the interior of the innerspring, since people sit on the edge of the innerspring when sitting or rising. The added stresses and strains on the sides can result in greater wear that is manifested in a tipping or side-sway about the border thereof. This type of wear may reduce the comfort of the item, and can result in unevenness of the side. The innerspring can further give the impression of a degree of softness it does not have, since a person sitting on the edge provides a much more concentrated load on the underlying springs than a prone individual lying upon the innerspring.

It has thus been found desirable to reinforce and provide greater stability to the edges of an innerspring assembly. For instance some, as in U.S. Pat. No. 3,262,135, have provided a resilient foam material border member perimetrically surrounding the innerspring that freely and independently supports loads apart from the innerspring. Others, as in U.S. Pat. No. 2,826,769, have devised a structure and method of adding resilient foam material about the perimetrical innerspring edge and affixed to the border strip material. Compression of this structure may create slack in the border allowing such edge arrangements to potentially disengage from respective coils, thereby reducing the effective advantages of the original structure.

Other efforts have also been directed, as shown in U.S. Pat. No. 3,618,146, to a border stabilizer formed from a plurality of foam strips positioned along the perimetrical row of spring coils of an innerspring. Each strip is slit to fit over one or more convolutions of the outermost coils. Another similar design depicted in U.S. Pat. No. 3,822,426, has a combined mattress topper pad and border stabilizer with one or more slits provided in the stabilizer portion to fit the generally rectangular cross-sectioned stabilizer onto the springs.

A method of stabilizing and reinforcing a spring border is also shown in U.S. Pat. No. 5,133,116, wherein a continuous length of resilient foam rope is wedged between convolutions of adjacent springs a plurality of turns about the perimeter of the coil spring assembly.

SUMMARY OF THE INVENTION

It is a principal objective of the present invention to provide an improved stabilizing member of resilient material for an innerspring assembly, and method of making an innerspring using this member, wherein the stabilizing member can be placed internally in the innerspring, i.e., it is not restricted to placement along the outboard edge of the unit, and is configured to be easily inserted between adjacent rows of spring coils. It is a further objective to provide such a stabilizing member with a unique cross-sectional shape which allows some control over the firmness and spring characteristics of the member.

To these and other ends, the present invention comprises an innerspring assembly of a plurality of springs defining a support surface with at least a first row of spring elements, and a second row of springs spaced inboard thereto and generally parallel to the first row of springs. A gap is formed between the first and second spring rows. The springs making up the support surface are retained in position by conventional means, as by cross-helical interconnection.

At least one elongated stabilizing member of resilient material, having a longitudinal axis and a cross-section with major and minor axes, is located between the first and second spring rows in the gap therebetween, as by sliding the resilient member along its longitudinal axis into the gap. The major axis of the resilient member extends substantially perpendicular to the support surface.

In a preferred embodiment, an innerspring assembly for cushions, mattresses and the like, may readily be stabilized simply and efficiently by providing an elongated resilient foamaceous member having a rhomboid-shaped cross-section with the aforementioned major and minor axes. The springs are organized into orthogonal rows. The resilient member, provided in four or more separate pieces for a mattress innerspring, for example, is inserted between the outermost (or perimetrical) row of springs and the next adjacent inboard row, with the major axis of the member extending perpendicular to the support surface. The border of a mattress, for example, is thereby stabilized without modification to a typical innerspring assembly, and without any slits or other means required in the foam member to affix the member in the innerspring.

The resulting construction improves the compression resistance about the perimeter of the spring unit, and reduces sagging. There is also no interference with the edge appearance of the unit because the member is located interior of the perimetrical coils.

Additionally, the border stabilizing member spring rate may be matched with, or otherwise related to, that of the surrounding springs to reduce any noticeable transition variations between compression of the border area and then the interior area of the innerspring, or to otherwise modify the edge firmness. The border stabilizing member firmness can also be varied by selecting the compression characteristics of the foamed material itself, by altering the internal geometry of the member, or some combination of the two.

In a disclosed embodiment, the major axis of the rhombus-shaped cross-section is nearly three times that of the minor axis, yielding a thin-width but tall cross-section. This shape has been found to yield a variable rate of firmness. The shape also facilitates insertion of the resilient members between spring rows.

In another disclosed embodiment, the border stabilizing member utilizes the same general rhombus-shaped cross-section, but flares the ends of the cross-section outwardly, yielding a trapezoidal top and bottom shape which is superposed on the overall rhombus-shaped cross-section. This rhombus-with trapezoid-end configuration has been found particularly advantageous in innersprings where the spring spacing is close, leaving a more confined space between rows. Since the width of the stabilizing member becomes reduced to fit within the confined space available, the superposed trapezoid end shape has been found to satisfactorily modify the overall rhombus cross-section to support expected loads while also still roughly matching the spring characteristics of the adjacent spring coils.

The foregoing features and advantages of this invention will be further understood upon consideration of the following detailed description of presently preferred embodiments of the invention taken in conjunction with the accompanying drawings, in which:

DETAILED DESCRIPTION OF PRESENTLY PREFERRED EMBODIMENTS OF THE INVENTION

The present invention is hereafter described in its application in an innerspring assembly for a mattress. It will of course be understood that, while it is described in this particular environment, the border stabilizing member and method of making an innerspring using the same is considered to have utility in other products utilizing an innerspring assembly, such as seats and cushions.

Figure 1:
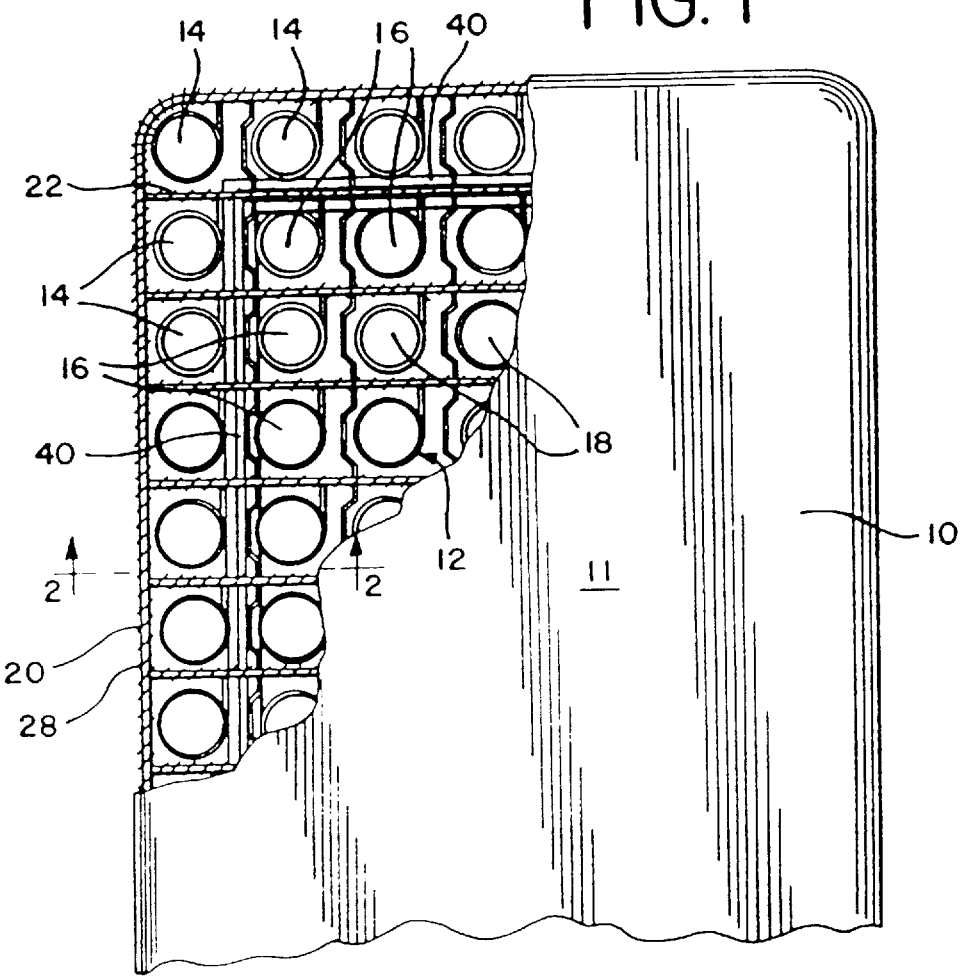
FIG. 1 is a plan view of a mattress innerspring made in accordance with the teachings of this invention.

Referring to the drawings, in FIG. 1 mattress 10 has an innerspring unit or assembly 12 comprised of perimetrical springs 14, adjacent springs 16, and interior springs 18 arranged in a rectangular pattern of parallel rows and orthogonal columns (hereafter, both being referred to as "rows" regardless of the direction they run). Although only a portion of the figure is broken out to expose the innerspring assembly, it is to be understood that these rows extend across the length and width of innerspring assembly 12.

Border wires 28 extend around the perimeter of innerspring assembly 12 on the top and bottom surfaces. Border wire helical spring 20 attaches the terminal convolutions of perimetrical springs 14 to border wire 18. Cross-helical springs 22, extending across the innerspring assembly 12, attach to terminal ends of adjacent adjoining perimetrical springs 14, adjacent springs 16 and/or interior springs 18, as is readily noted in FIG. 1. The cross-helicals 22 could also extend lengthwise, if so desired.

Figure 2:
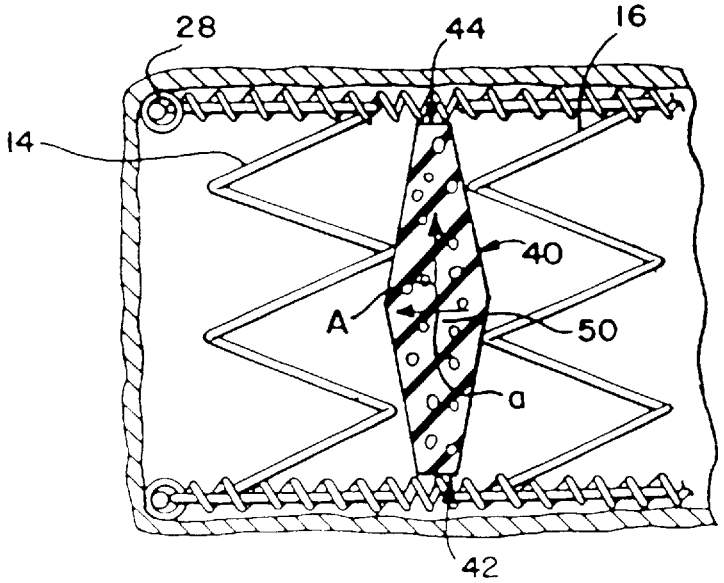
FIG. 2 is a cross-sectional view taken along line 2—2 of FIG. 1.

Referring to FIG. 2, all of the springs 14, 16, 18 are identical. The springs have larger diameter convolutions at the terminal ends thereof, and smaller diameter convolutions or turns, in between. A gap is thereby provided between joined springs; a gap is as well provided between rows of adjacent springs which do not have their terminal convolutions so joined.

Located within the gap between coils 14 and 16 is resilient stabilizing beam member 40. The member 40 is elongated, with a generally rhombus-shaped or diamond-shaped exterior, having a longitudinal axis and a cross-section with a major axis A as measured along the diagonal between where two diametrically opposed corners would be with the side surfaces of the rhombus-shape being fully extended to terminate at a point and a minor axis as a measured along diagonal between where the other two diametrically opposed corners are, would be, as defined by the intersection of the side surfaces of the rhombus-shape. In this embodiment of FIG. 2, member 40 is substantially solid and composed of a generally uniform resilient foamed material. The major axis "A" of member 40 is oriented substantially parallel to the longitudinal axes of the surrounding coils 14 and 16 i.e., perpendicular to the support surface, and the minor axis "a" extends generally perpendicular to the longitudinal axes of the springs. The exterior of member 40 is dimensioned to preferably contact the spring sides in its uncompressed state. Although the ends of the member along major axis A may terminate at a point, it is preferable to truncate the ends with parallel planar sides 42, 44. In this embodiment, the cross-sectional shape comprises two trapezoids and has symmetry about the minor axis. The height (major axis A) of the resilient member 40 is slightly less than the height of the springs.

Member 40 may readily be placed in the previously described orientation within the bare innerspring 12 (i.e., prior to build-up or upholstery) in the following manner. A resilient foam member 40 is generally in one piece. A plurality of such pieces, or segments, may be employed together. For a mattress innerspring, such segments would be inserted first at one end of the unit, then along the sides, then along the opposite end, in the long gaps defined between the rows of springs 14 and 16. 33 inch and 24 inch long segments have been found advantageous. For example, along the side of a full-size mattress a first 33 inch segment of the resilient foam member 40 is inserted along a path parallel to a side of innerspring 12 between perimetrical coils 14 and adjacent coils 16 for its full length. Another 33 inch segment is then abutted to the first segment, and inserted advancing the previously inserted piece along the gap. The two segments thereby extend along substantially the entire lateral side of the innerspring 12. The other side and ends of the unit are reinforced in the same manner (although a single 33 inch segment may be sufficient for some ends). Upon completion of the inserting operation, the unit may be finished with ticking, padding and covering material, generally indicated as 11 in FIG. 1.

It can be readily appreciated by those skilled in the art that the firmness characteristics of the border created by this assembly can be varied by the compression characteristics of the resilient foam material, and the internal geometry of the beam member. For example, a rhomboid-shaped hollow interior 50, 50' centered on the member's centroid, as in FIG. 3 and 4, may be utilized to create borders of lesser firmness. By varying the density and rigidity of the foam, the degree to which the foam resists compression can also be adjusted as desired. For purposes of the present invention, any durable elastically compressible foam, such as polyurethane foam, polyethylene foam, foam rubber, or latex foam, with a suitable density characteristic may be employed, and it is advantageous that this material have a tensile strength which resists tearing. A high density polyethylene foam with a density of approximately 2.0 lbs./cu. ft. minimum has been found useful in the FIG. 2 embodiment. Moreover, it can also be readily appreciated that an interior hollow (50, 50') within the member may be filled with a resilient material of a density greater or lesser than the material comprising the exterior of the beam, thereby creating a member with dual density properties.

It can also be readily appreciated that the spring rate of the member 40 may be altered by changing the exterior geometry thereof. For example, while it has been determined that a rhomboid-shaped exterior with truncated major axis ends is preferred in "matching" spring rates with existing innerspring coils, other but similar shapes may be useful. The preferred configuration has the additional benefit of firming substantially the full lengths of surrounding coils, because prior border stabilizers generally firmed the interior of perimetrical coils, thus requiring compression of at least a full convolution before realizing a firming effect from the stabilizer.

By way of specific example, member 40 composed of high density polyethylene foam of approximately 2.0 lbs./cu. ft. minimum density has a major axis "A" dimension terminating at truncated points 42, 44 of 4¾ in. and minor axis "a" dimension of 1⅝ in. The truncated portions 42, 44 have a width of ½ in. The cross-sectional area is approximately 5.05 sq. in. The member 40 is thus tall and thin, having a minor axis about ⅓ of the major axis, in keeping with the thin-width of the spring gaps within which it is to be inserted, and the desirable firmness to be achieved.

Figure 3:
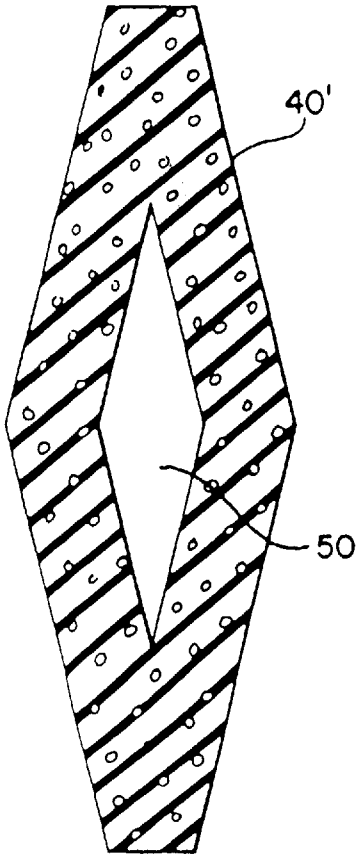
FIG. 3 is a cross-sectional view through a member similar to that of FIG. 2 of another embodiment.

The FIG. 3 embodiment, member 40', has a rhomboid-shaped hollow interior 50, and a major axis A dimension of 4¾ in., and a minor axis a dimension of 1⅝ in. The truncated portions have a length of ½ in. Thus, in this embodiment, the cross-section includes two trapezoid cross-sections outlined by dotted lines in FIG. 3. Rhomboid-shaped hollow interior 50, centered on the centroid of member 40', has a dimension along major axis A of 2½ in. and a dimension along minor axis a of ⅝ in. This resulting cross-sectional area is approximately 4.29 sq. in.

Figure 4:
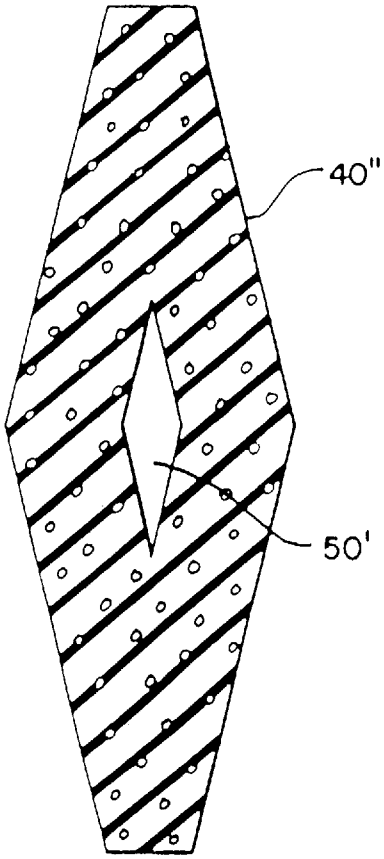
FIG. 4 is a cross-sectional view similar to that of FIG. 3 of yet another embodiment.

The FIG. 4 embodiment, member 40", also has a rhomboid-shaped hollow interior 50', with major and minor axes as in the FIG. 3 embodiment. Rhomboid-shaped hollow interior 50', centered on the centroid of member 40", has a dimension of 1 7/16 in. along the major axis and a dimension of 5/16 in. along the minor axis, resulting in a cross-sectional area of approximately 4.8 sq. in.

As to the method of placement of member 40 within innerspring 12, it can be readily appreciated that a member 40 may be run other than between perimetrical coils 14 and coils 16 of innerspring 12. The member 40 may be placed only along certain sides, if so desired, or even further interior to the innerspring. Multiple segments may be placed between rows of coils, as described, but further could be of differing firmness characteristics corresponding to the use that the affected row sector may have. The segments may be cut normal to the length of the beam, or cut supplementary or complementary.

Figure 5:
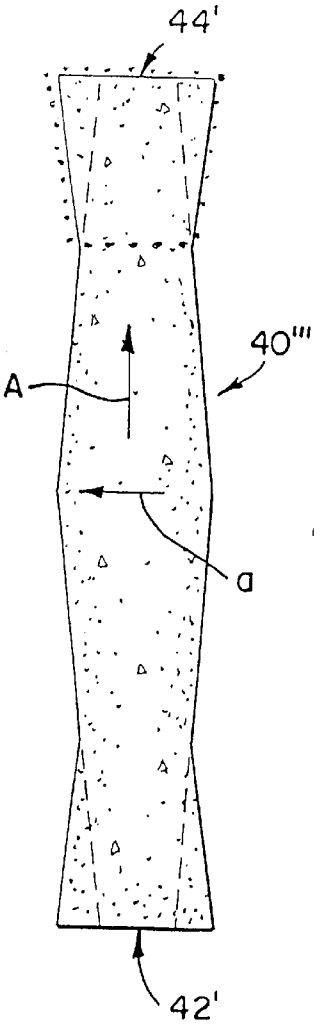
FIG. 5 is a cross-sectional view similar to that of the stabilizing member shown in FIG. 2 but of another embodiment made in accordance with the teachings of this invention.

FIG. 5 shows yet another embodiment which has been modified for particular application in an innerspring having fairly close spacing between adjacent spring rows. This results in a relatively confined space within which the stabilizing member is to be fit. The available width of the stabilizing member—minor axis a—is thereby reduced.

The rhombus shape for the cross-section of the stabilizing member, which has been found to be most desirable and advantageous, is maintained in the embodiment of FIG. 5, as highlighted by the phantom dashed lines on member 40'''. Member 40''' has further been provided with ends (in cross-section) which have a trapezoidal shape superposed upon the type of cross-section of the FIG. 2 embodiment. The trapezoidal shape, outlined in dotted line in FIG. 5, has the greater of its parallel sides located at the top and bottom sides 42', 44' of the member 40'''. In effect, the planar sides 42', 44' are widened by flaring the end configuration of the rhombus-shape outwardly. The resultant cross-section is therefore somewhat hourglass shaped above and below the minor axis a, i.e., two stacked hourglasses. In other words, as one moves along the major axis A in either direction from the minor axis a, the cross-section of this embodiment first gradually decreases in width (measured orthogonal to the major axis) and then gradually increases in width toward the top and bottom of the member. In this embodiment, the cross-sectional shape comprises four trapezoids and has symmetry about the minor axis.

Two factors which principally influenced this modified cross-section for member 40''' were the thinness of the width of the resulting stabilizing member and the intention to match the load deflection characteristics of the spring coils of the particular innerspring. As mentioned above, a concept involved in the present invention is to have an edge firming device which "mimics" the load deflection characteristics of the innerspring to which it is to be applied.

The widened top and bottom sides 42', 44' form better surfaces to support the anticipated loads, thus accommodating the thinner width (minor axis a) for the embodiment of FIG. 5. It was also determined that this cross-section shape for stabilizing member 40''' more closely matched the deflection characteristics of the innerspring in which this embodiment was to be applied.

Figure 6:
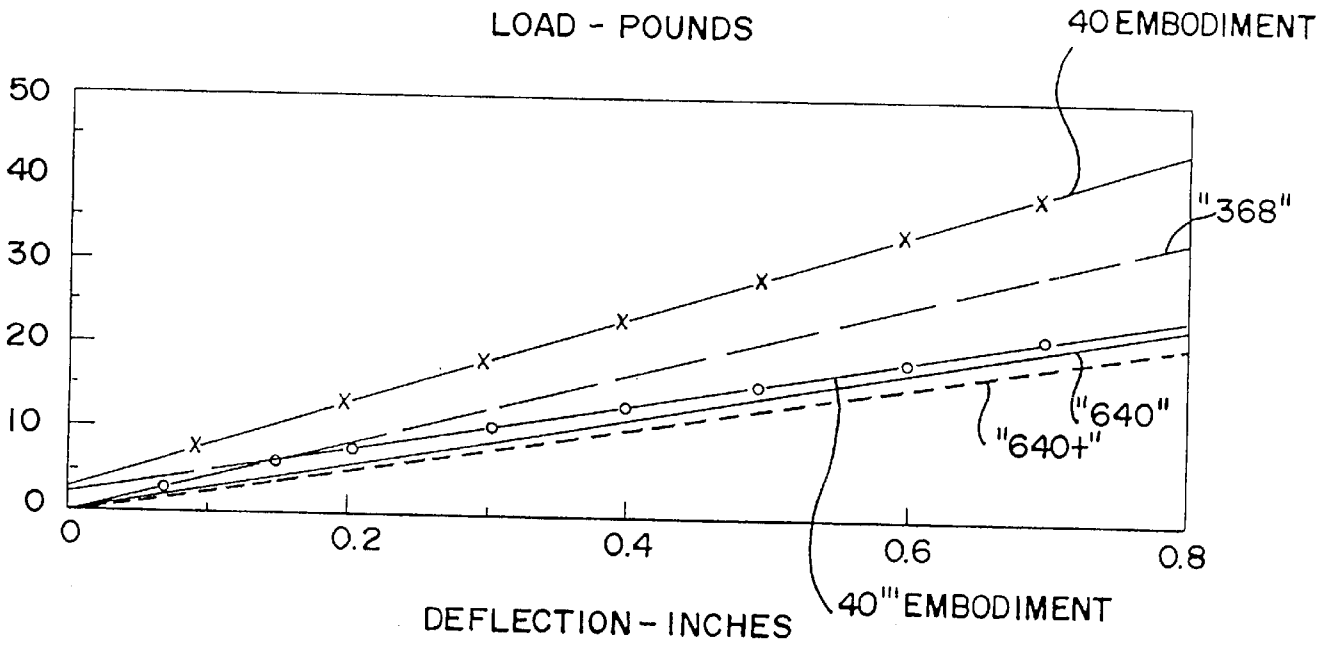
FIG. 6 is a graph showing testing of embodiments similar in cross-section to what is shown in FIGS. 2 and 5.

The graph of FIG. 6 shows plots of deflection of various springs as well as stabilizing members made in accordance with the teachings of this invention and of the types 40 and 40'''. The member 40 embodiment was tested in conjunction with a so-called "368" innerspring having spring coils of 12¾ gauge with knotted terminal convolutions of a triple-offset type. Testing was accomplished by making a bun (i.e., a small sample innerspring) and placing an 8 in. diameter platen on the top surface of the bun, roughly centered thereon. Weight was progressively added to the platen up to about 50 lbs., and deflection of the springs progressively measured. One bun was of the innerspring including the member 40 embodiment (indicated as "40 Embodiment" on the graph), and the other bun was without the stabilizing member (indicated as "368"). As can be seen from FIG. 6, the type 40 member fairly tracked the deflection characteristics of the "368" innerspring into which it was applied.

The type 40''' member also was tested in a similar fashion in conjunction with a so-called "640" innerspring having spring coils of 14½ gauge with open-offset terminal convolutions, and also a "640+" innerspring having 14 gauge coils. The modified shape of the member 40'" embodiment (indicated on the graph as "40'" Embodiment") tracks the load deflection characteristics of these innersprings, as shown.

Thus, while the invention has been described with reference to a particular embodiment, further applications and modifications of the invention will be apparent to others. The foregoing description of the preferred embodiments of the present invention has been presented for purposes of illustration and description, and is not intended to be exhaustive or to limit the invention to the precise form disclosed. Modifications and variations are possible in light of the above teachings, yet still fall within the scope of the claims hereafter. It is intended that the scope of the invention be defined by the following claims, including all equivalents.

What is claimed is:

1. A method of stabilizing and reinforcing an innerspring assembly, including springs having spring rates and with first and second rows of springs having parallel longitudinal axes and a gap between the first and second rows of springs, for cushions and mattresses, comprising the steps of:

forming an elongated member of resilient foamaceous material for insertion in the gap between first and second rows of springs in the innerspring assembly, the elongated member having a longitudinal axis extending along its elongate length, and exterior surfaces generally parallel to the longitudinal axis defining a general rhombus-shaped cross-section orthogonal to said longitudinal axis having a major axis and minor axis, said major axis being of greater length than said minor axis, the cross-section perimeter having a generally rhombus shape with the major axis as measured along the diagonal between where two diametrically opposed corners would be with the sides of the rhombus shape being fully extended to terminate at a point, and the minor axis as measured along another diagonal between where the other two diametrically is opposed corners would be with the sides of the rhombus shape being fully extended to terminate at a point, with said cross-section and resilient material to in combination yield a spring rate for the elongated member which approximates the spring rate of the innerspring assembly, and inserting the resilient elongated member between the first and second rows of springs by sliding the member within the gap in a direction parallel to the first and second rows of springs with the minor axis of the elongated member substantially orthogonal to the longitudinal axes of the first and second rows of springs of the innerspring assembly.

2. The method according to claim 1 wherein the resilient elongated member cross-section perimeter shape includes truncated top and bottom ends orthogonal to the major axis and a trapezoid shape superposed upon each end of the general rhombus shape on the major axis with the greater of the parallel sides of each of the trapezoid shaped being coextensive with each of the ends of the general rhombus shape.

3. The method according to claim 1 wherein the resilient foamaceous elongated member cross-section includes a longitudinal hollow interior of rhombus shaped cross section with a centroid, the hollow interior cross section centroid generally located at the intersection of the major and minor axes of the member cross-section.

4. The method according to claim 3 further comprising the step of filling the elongated member hollow interior with a resilient foamaceous material of a density lesser than the resilient foamaceous material of the member surrounding the hollow interior.

5. The method according to claim 3 further comprising the step of filling the elongated member hollow interior with a resilient foamaceous material of a density greater than the resilient foamaceous material of the member surrounding the hollow interior.

6. The method according to claim 1 wherein the resilient elongated member perimeter shape is further defined by the cross-section first gradually decreasing in width and then gradually increasing in width, as measured orthogonal to the major axis beginning from said minor axis and then progressing away from the minor axis along said major axis and progressively measuring orthogonal to said major axis towards the perimeter of the cross-section.

7. The method according to claim 6 wherein the resilient elongated member perimeter shape cross-section is generally symmetric about the minor axis.

8. The method according to claim 1 wherein the resilient elongated member perimeter shape is further defined by the cross-section, generally symmetric about the major axis, first gradually decreasing in width and then gradually increasing in width as measured orthogonal to the major axis beginning from the minor axis and then progressing away from the minor axis along the major axis and progressively measuring orthogonal to said major axis towards the perimeter of the cross-section.

9. The method according to claim 8 wherein the resilient elongated member perimeter cross-section is generally symmetric about the major and minor axis.

10. A method of stabilizing and reinforcing an innerspring assembly, comprised of springs having spring rates and with first and second rows of springs having parallel longitudinal axes and a gap between the first and second rows of springs, for cushions and mattresses, comprising the steps of:

forming first and second elongated members of resilient foamaceous material for insertion in the gap in the innerspring assembly, each elongated member having a longitudinal axis extending along its elongate length, and exterior surfaces generally parallel to the longitudinal axis defining a generally rhombus shaped cross-section orthogonal to the longitudinal axis, said cross section with one set of opposing comers truncated by parallel planar edges, thereby forming a cross section including two trapezoids, the greater parallel side of each trapezoid defining a minor axis, said minor axis orthogonal to a major axis, the major axis being of greater length than the minor axis, the cross-section perimeter including the non-parallel sides of each trapezoid the cross-section and resilient material to in combination yield a spring rate for each elongated member which approximates the spring rate of the innerspring assembly, inserting the first resilient elongated member between the first and second rows of springs by sliding the member within the gap in a direction parallel to the first and second rows of springs with the minor axis of the first elongated member substantially orthogonal to the longitudinal axes of the first and second rows of springs of the innerspring assembly, and inserting the second resilient elongated member in the gap in a direction parallel to the first and second rows of springs and abutting the first resilient elongated member to thereby advance the first and second resilient elongated members along the gap.

11. The method according to claim 10 wherein each of the first and second resilient elongated members have cross-sections that include a longitudinal hollow interior with a rhombus shaped cross section, the hollow interior cross section having a centroid that is generally located at the intersection of the major and minor axes of the cross-section.

12. The method of claim 11 further comprising the step of filling each elongated member hollow interior with a resilient foamaceous material of a density lesser than the resilient foamaceous material of the member surrounding the hollow interior.

13. The method of claim 11 further comprising the step of filling each elongated member hollow interior with a resilient foamaceous material of a density greater than the resilient foamaceous material of the member surrounding the hollow interior.

14. The method according to claim 10 wherein each resilient foamaceous elongated member cross-section is generally symmetric about the minor axis.

15. The method according to claim 14 wherein each resilient foamaceous elongated member cross-section perimeter shape further includes a trapezoid shape superposed on the truncated edge, with the greater of the parallel sides of the superposed trapezoid shape perpendicular to the major axis of the cross section.

16. The method according to claim 10 wherein each resilient elongated member cross-section is generally symmetric about the major axis.

17. The method according to claim 16 wherein each resilient foamaceous elongated member cross-section perimeter shape further includes trapezoid shape superposed on the truncated edge with the greater of the parallel sides of the superposed trapezoid shape perpendicular to the major axis of the cross section.

18. The method according to claim 10 wherein each resilient elongated member cross-section is generally symmetric about the major and minor axes.

19. The method according to claim 18 wherein each resilient foamaceous elongated member cross-section perimeter shape further includes a trapezoid shape superposed on the truncated edge with the greater of the parallel sides of the superposed trapezoid shape perpendicular to the major axis of the cross section.

* * * * *

UNITED STATES PATENT AND TRADEMARK OFFICE

CERTIFICATE OF CORRECTION

PATENT NO. : 5,832,551
DATED : November 10, 1998
INVENTOR(S) : Wagner

It is certified that error appears in the above-identified patent and that said Letters Patent is hereby corrected as shown below:

Column 4, line 24, [as a] should be --a as--

Column 4, line 26, insert "or" before would

Column 8, Claim 10, line 43, [comers] should be --corners--

Column 8, Claim 9, line 29, after perimeter insert --shape--

Column 10, Claim 17, line 8 insert --a-- after includes

Signed and Sealed this

Fifteenth Day of June, 1999

*Attest:*

Q. TODD DICKINSON

*Attesting Officer*

*Acting Commissioner of Patents and Trademarks*